US009109397B2

(12) United States Patent
Carlsson et al.

(10) Patent No.: US 9,109,397 B2
(45) Date of Patent: Aug. 18, 2015

(54) DRILL STRING COMPONENT FOR NOISE CONTROL DURING PERCUSSION DRILLING

(75) Inventors: Jimmy Carlsson, Fagersta (SE); Göran Stenberg, Fagersta (SE); Alexander Beronius, Fagersta (SE); Mattias Göthberg, Örebro (SE); Samuel Enblom, Örebro (SE)

(73) Assignee: Atlas Copco Secoroc AB, Fagersta (SE)

( * ) Notice: Subject to any disclaimer, the term of this patent is extended or adjusted under 35 U.S.C. 154(b) by 355 days.

(21) Appl. No.: 13/261,180

(22) PCT Filed: Aug. 30, 2010

(86) PCT No.: PCT/SE2010/000211

§ 371 (c)(1),
(2), (4) Date: Feb. 13, 2012

(87) PCT Pub. No.: WO2011/025431

PCT Pub. Date: Mar. 3, 2011

(65) Prior Publication Data

US 2012/0138367 A1 Jun. 7, 2012

(30) Foreign Application Priority Data

Aug. 28, 2009 (SE) ..... 0901137

(51) Int. Cl.

| | |
|---|---|
| ***E21B 3/02*** | (2006.01) |
| ***E21B 1/00*** | (2006.01) |
| ***E21B 17/00*** | (2006.01) |
| ***E21B 17/07*** | (2006.01) |

(52) U.S. Cl.

CPC . *E21B 1/00* (2013.01); *E21B 17/00* (2013.01); *E21B 17/07* (2013.01)

(58) Field of Classification Search

USPC ..... 175/56, 135, 414, 415, 113

See application file for complete search history.

(56) References Cited

U.S. PATENT DOCUMENTS

| | | | |
|---|---|---|---|
| 3,819,168 | A | 6/1974 | Nittinger et al. |
| 3,842,942 | A | 10/1974 | Jensen et al. |
| 3,926,265 | A | 12/1975 | Bouyoucos |
| 3,971,447 | A | 7/1976 | Ahlberg et al. |

(Continued)

FOREIGN PATENT DOCUMENTS

| | | | |
|---|---|---|---|
| DE | 2602021 | A1 | 7/1977 |
| DE | 3238253 | A1 | 5/1983 |

OTHER PUBLICATIONS

Int. J. Rock Mech. Sci. & Geomech. Abstr. vol. 16, pp. 363-376; Pergamon Press Ltd. 1979, GB;"Investigation of Noise and Vibration in Percussive Drill Rods".

(Continued)

*Primary Examiner* — Kenneth L Thompson
*Assistant Examiner* — Taras P Bemko
(74) *Attorney, Agent, or Firm* — Mark P. Stone

(57) ABSTRACT

Rock drilling equipment and drill string components (2;18) for top hammer drilling and down-the-hole drilling for positioning between a drill rig and a drill bit include a pipe-shaped element (3;19), which is arranged for transferring only rotational movements from the drill rig to the drill hit. A vibration-damping structure (12) is arranged adjoining to at least a part of an inside (11) of the pipe-shaped element in a space (41) formed inwardly of the inside (11).

18 Claims, 4 Drawing Sheets

(56) References Cited

U.S. PATENT DOCUMENTS

| | | | | |
|---|---|---|---|---|
| 4,168,754 | A | 9/1979 | Nyholm | |
| 4,296,830 | A | 10/1981 | Rossander et al. | |
| 4,591,009 | A | 5/1986 | Marcel et al. | |
| 5,005,656 | A | 4/1991 | Rodert | |
| 5,209,311 | A | 5/1993 | Donse | |
| 6,427,782 | B2 | 8/2002 | Brady | |
| 7,210,555 | B2 | 5/2007 | Shah et al | |
| 2005/0279565 | A1 | 12/2005 | Arian et al. | |
| 2006/0000645 | A1 * | 1/2006 | Stjernstrom et al. | 175/107 |

OTHER PUBLICATIONS

Inter-noise Jul. 21-23, 1986; Cambridge US; Concentric Drill Steels for Noise Reduction of Percussion Drilling, (Stein, Aljoe).

* cited by examiner

DRILL STRING COMPONENT FOR NOISE CONTROL DURING PERCUSSION DRILLING

BACKGROUND OF THE INVENTION

The invention concerns devices for noise control during percussion drilling.

BACKGROUND OF THE INVENTION

Equipment for rock drilling emits noise of high level. Specific for such types of equipment, the noise emanates on the one hand from the hammer drilling machine, in top hammer drilling as well as in down-the-hole drilling, on the other hand from the components of the drill string. During, percussion drilling, the most important source of noise generation is the bending vibrations in the rod elements, the impact rods, caused by their instantaneous bending which is induced in connection with the impacts. Hereby the bending is in general caused by the drill bit at impact meeting an uneven opposing substrate.

When the impact wave or the shock wave from the hammer reaches the drill bit, a bending moment thereby occurs because the drill bit meets different resistance at its different front portions.

In common for equipment of these kinds is that they are subject to strict restrictions as concerns the level of emitted noise to be used in connection with other activities.

For the purposes of limiting noise emissions from drill rigs and associated components i.a. has been suggested to isolate the percussive drilling machine and the drill string from the surroundings through noise damping housings. This solution, however, brings along a number of disadvantages such as extra costs and reduced flexibility during drilling. Further, the operator will be shielded from the components, giving inferior possibilities of operation control.

Another solution that has been tested is to provide the elements of the drill string with friction rings, which, however, have, had limited effect and which have been difficult to keep in position.

Considerations concerning reduction of noise from drill strings have resulted in suggestions to redesign involved elements, for example through reduction of tolerances such that the bending vibrations would be eliminated or at least reduced.

As examples of background art can also be mentioned: "Int. J. Rock Mech. Sci. & Geomech. Abstr. vol. 16, sid. 363-376; Pergamon Press Ltd 1979, GB; Investigation of Noise and Vibration in Percussive Drill Rods", "Inter-noise 1986 July, 21-23 Cambridge US; Concentric drill steels for noise reduction of percussion drilling, (Stein, Aljoe)", U.S. Pat. No. 3,926,265, U.S. Pat. No. 4,168,754, U.S. Pat. No. 4,591,009, U.S. Pat. No. 6,427,782B2, U.S. Pat. No. 7,210, 555B2, US2005/0279565A1.

Aim and Most Important Features of the Invention

The aim of the present invention is to address and at least mediate the problems of the background art and to provide drill string components wherein the resulting noise emission from the drill string is reduced.

This aim is achieved in respect of drill string components according to the respective preamble of the respective independent claims in that a vibration-damping structure is arranged adjoining to at least a part of an inside of the pipe-shaped element in a space formed inwardly of said inside.

According to a first aspect of the invention, the drill string component is constructed for the application in respect of a top hammer machine. According to a second aspect of the invention, the drill string component is constructed for the application in respect of a down-the-hole drilling machine. In both cases the pipe-shaped element only transmits rotational movements. In the case of a top hammer machine, percussion action is transmitted to the drill bit over impact pulse transferring rod elements being arranged inside the pipe-shaped element. In the case of a percussive down-the-hole drilling machine, impact action is transmitted directly from this down-the-hole drilling machine to the drill bit.

Through the invention it is achieved that noise emissions from the drill-string can be reduced to tolerable levels without having to-enclose the drill string or take any measures which might influence the operation.

Dumping of structures is in general caused by energy being consumed through hysteresis in the material, resulting in losses in the very materials itself and possible slip in joints, resulting in —frictional losses between materials.

According to the invention, the vibration-damping structure can be arranged adjoining to at least a part of said inside. Hereby is intended that the structure lies against the inside and that the complete side does not have to be covered by, or be adjoining to, the vibration-damping structure. It is also advantageous, for wear reasons, that the vibration-damping structure is arranged adjoining to said inside, within said space, since thereby the risk of damaging the structure under operation, is reduced.

In a preferred embodiment of the invention, the vibration-damping, structure is manufactured from a vibration-damping material which is applied in a layer on at least a part of said inside. The effect of this is that noise generating vibrations are transferred to and converted into heat in the material. Generated heat can subsequently be carried off by way of flushing fluid flowing through the drill string component. It is thereby suitable that said material is anyone from the group: 1) viscoelastic materials: a) amorphous materials, b) materials having amorphous components, otherwise being crystalline; 2) composite materials with a metal matrix and with particles from a material which is harder compared to the matrix material.

In order to enhance wear properties, at least in some applications and for some materials, suitably a side of the vibration-damping structure being turned away from the pipe-shaped element is provided with a reinforcing wear-resistant layer.

In a further, preferred, embodiment of the invention, the vibration-damping structure is constructed as an elongated sleeve being inserted into said space and lying against at least a part of said inside.

The elongated sleeve preferably provides at least one axially extending through channel for allowing flow of fluid between the drill rig and the drill bit.

The drill string component according to the first aspect of the invention is thus a component of a drill string for a top hammer and includes (at least) one rod element extending along a longitudinal axis for transmitting impact pulses from a percussion drilling machine to a drill bit, wherein the pipe-shaped element is arranged concentrically, surrounding the rod element, wherein said element is limited inwardly by an outside of the rod element.

The invention has advantageous effect in drill string components arranged according to this principle, wherein impact rods without threads are added end to end inside treaded pipe-shaped elements, and wherein the impact rods are used only to transfer percussion energy and feed force, whereas the pipe-shaped elements only transfers rotation. Products according to this principal are marked by the applicant under the name "COPROD".

At introduction of this system it had been expected that noise-emissions from the drill string would be essentially reduced because of the shielding action by the drill pipe. Since it has been discovered that the noise emissions have not been reduced sufficiently in this system, the invention contributes in an advantageous manner to noise emission reduction in this type of equipment.

The drill string component according to the second aspect of the invention is thus a component of a drill string of a down-the-hole drilling machine.

Also drill string components for down-the-hole drilling suffer from noise emissions, and thus drill string components also for this type of equipment are included in the invention. Hereby the noise is of somewhat other kind than is the case in respect of top hammer equipment; but also in these cases noise reduction can be of great value. In these cases it is in respect of pipe-shaped elements between the drill rig and the down-the-hole drilling machine/the drill bit.

The invention also relates to rock drilling equipment including a drill string component, wherein the corresponding advantages are obtained.

Further features and advantages of the invention are clarified by the further dependent claims and the following description.

BRIEF DESCRIPTION OF DRAWINGS

The invention will now be described in more detail at the background of embodiments and with reference to the annexed drawings, wherein.

DESCRIPTION OF EMBODIMENTS

Figure 1:
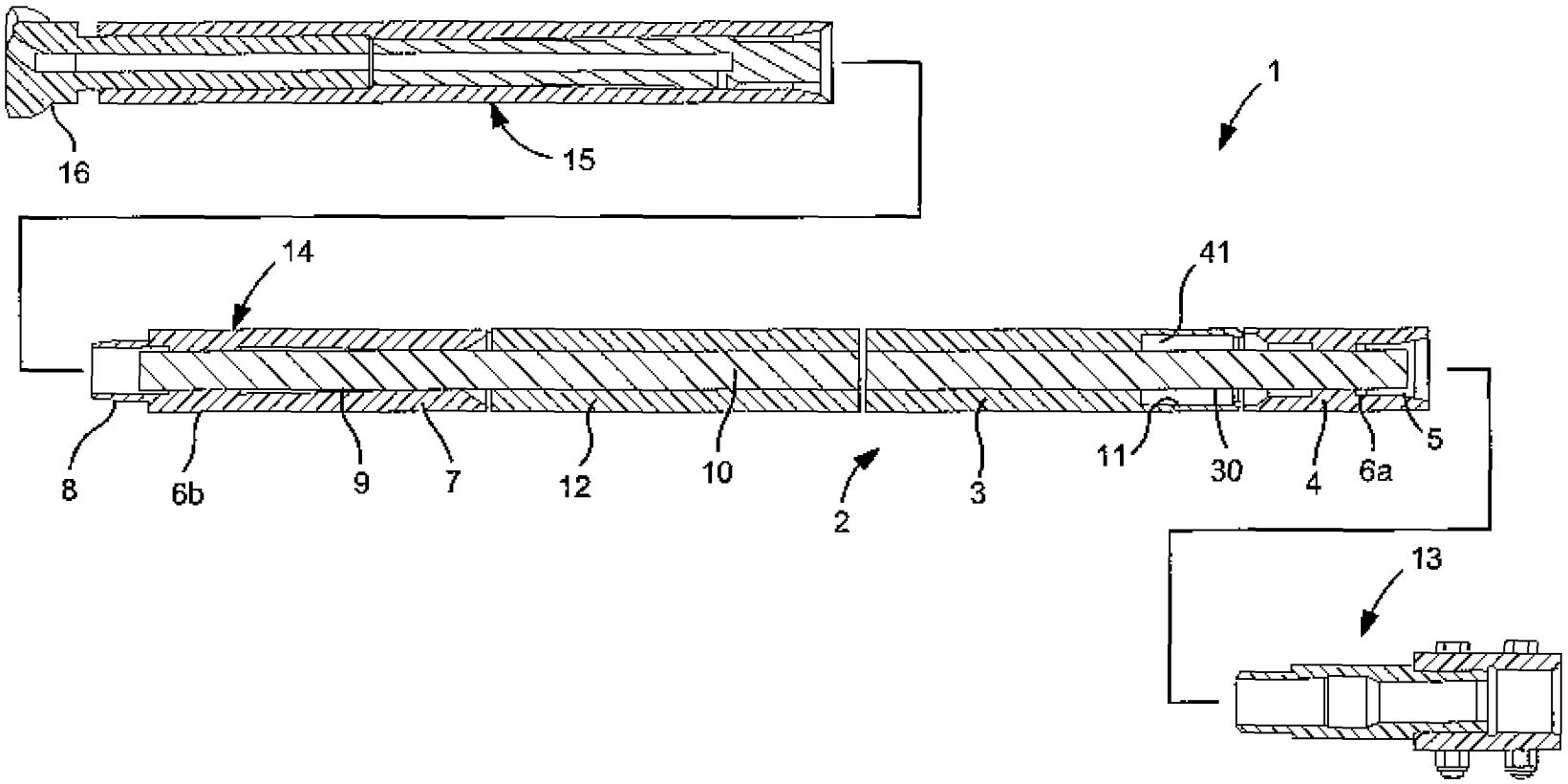
FIG. 1 shows in an axial section and partly disassembled, components of a drill string according to the invention in a first embodiment.

FIG. 1 shows (part of) a drill string 1 including a drill string component 2 according to the invention, which includes a pipe-shaped element 3 for transferring rotational movement between a drill rig and a drill bit. At the first, upper end, the drill string component 2 has a first, upper joining portion 4 which provides a first thread 5 for connection to for example a further drill string component or to any other component in question. Further, the first joining portion has a guide sleeve 6*a* for guiding a rod element 10 in the form an impact rod for the transmission of impact pulses.

On its second, lower end, the drill string component 2 has a lower, second joining portion 7, which includes a second thread for a connection to a rod locking sleeve 14, which over a threaded joint 9 is threaded to the lower end of the pipe-shaped element. The rod lock sleeve 14 operates as an axial lock for the rod element 10 in order to prevent it from falling from the pipe-shaped element during handling. The rod lock sleeve 14 also carries a guide sleeve 6*b* for the rod element. Further, the rod lock sleeve 14 has a further thread 8 for the connection to a further drill string component or to any other component that is included into the drill string.

Said rod element 10, which comprises said impact rod, is thus arranged for transferring of impact pulses and feed force from said drill rig to said drill bit. Each rod element 10 is axially guided inside the respective pipe-shaped element 3 but guided by said guide bushing 6*a* and *b*. It is not excluded that each drill string component includes more than one impact rod, but this is not preferred.

In respect of an assembled drill string, a number of rod elements 10 are piled end to end on each other such that their respective end surfaces lie against each other. There is no further coupling together of the very rod elements through for example threads in this embodiment, and assembling of the drill string is provided by said pipe-shaped elements 3.

The pipe-shaped element 3 has an inside 11, within which is defined a space 41, which in this embodiment is also inwardly limited by an outside 30 of the rod element 10. In this space, according to the invention, there is positioned a vibration-damping structure 12, and in this embodiment, this structure is in the form of an elongated sleeve 12, which normally does not lie against said outside 30 of the rod element 10 but instead is at a minor distance therefrom.

The vibration-damping structure 12 provides damping of firstly the bending vibrations in the pipe-shaped element 3 and accomplishes that induced and/or forced vibrations in the pipe-shaped element are damped. Hereby is achieved that emission of noise from a drill string according to the invention is reduced compared to what would result from devices according to the background art.

On FIG. 1 there is besides the drill string component 2 also shown a connection element 13 for connecting a drill string component 2 in the region of the drill rig and a drill bit unit 15, which includes a drill bit 16. The components 13, 15 and 16 are of conventional kind.

Figure 2:
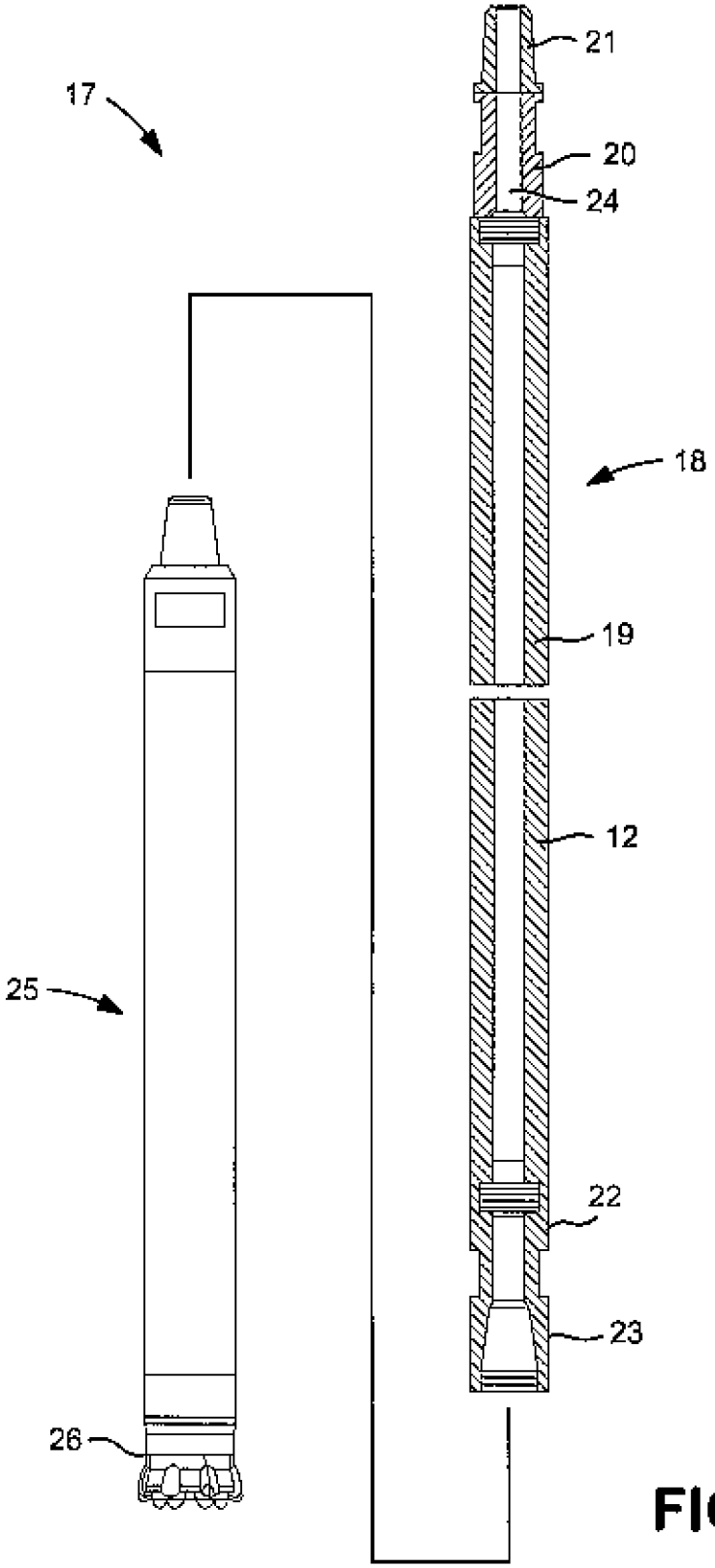
FIG. 2 shows the components of a drill string, partly in an axial section and partly disassembled, with a drill string component according to the invention in a second embodiment.

In FIG. 2 there is shown parts of a drill string 17 of a down-the-hole drilling machine 25, which as usual supports a percussive drill, bit 26. 18 indicates a drill string component, which this case includes a pipe-shaped element 19 and a first, upper joining portion 20 which in turn includes a first thread 21 for joining to further drill string components, to further components respectively, as well as a second, lower joining portion 22, which includes a second thread 23 for joining to a further drill string component etc.

Inwardly of the pipe-shaped element 19 there is arranged a vibration-damping structure 12, which can be of the same type as the one that is described in respect of FIG. 1 or be a vibration-damping layer of a vibration-damping material as will be exemplified below.

Figure 3:
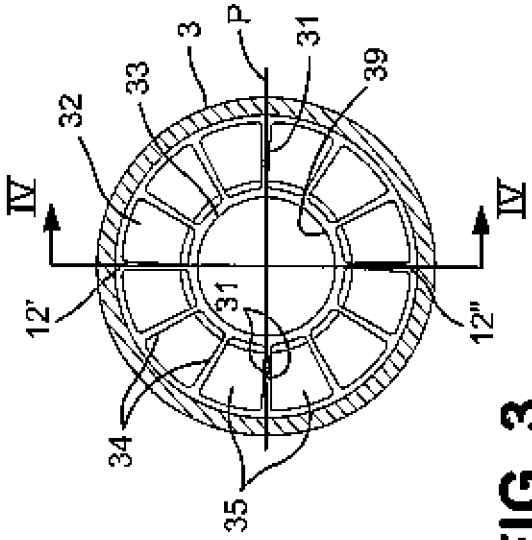
FIGS. 3 and 4 show a part of a drill string component essentially according to FIG. 1 in a greater scale in a cross section (section Ill in FIG. 4) and an axial section (section IV in FIG. 3), respectively.
Figure 4:
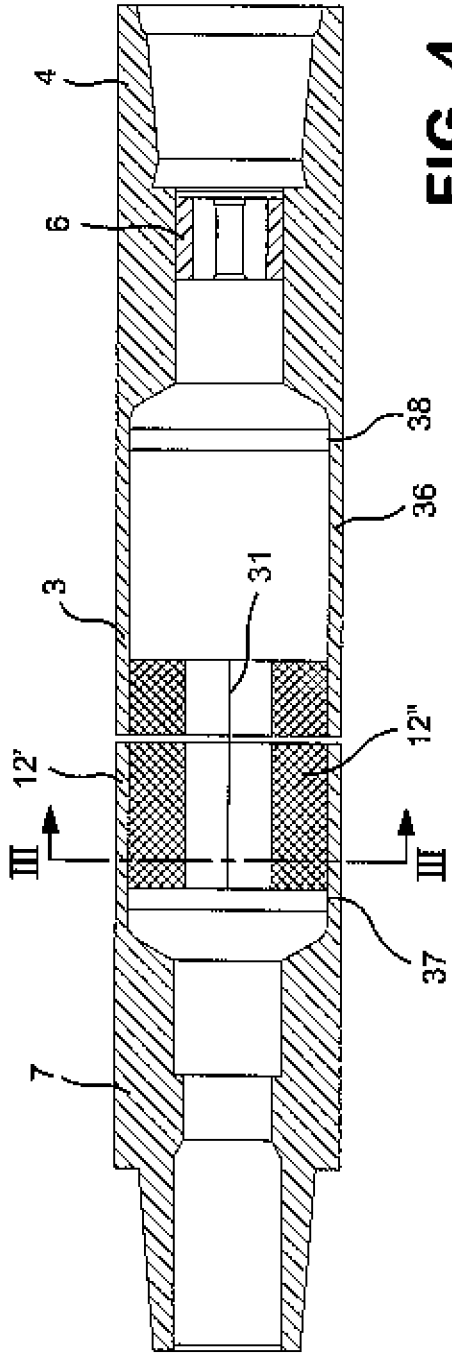

In FIGS. 3 and 4 there is shown in a larger scale parts of the drill string component 2 of FIG. 1, viz. the pipe-shaped element 3 with the vibration-damping structure 12. In this case the vibration-damping structure 12 is comprised of two similar halves 12' and 12", which together form a two-piece sleeve and which comprise contact surfaces 31 extending along a plane P and in parallel with the axis of the drill string component.

As is shown in FIG. 3, which shows the details in FIG. 4 in a cross section, the sleeve halves 12' and 12" form a sleeve structure, which comprises an outer shell 32 and an inner shell 33 together forming an outer tube-shaped construction 32 and an inner tube-shaped construction 33, which has an inside 39 when the halves are-assembled to a complete sleeve.

34 indicates axially extending distance strips, which function as a distance holders between the outer and inner tube-shaped constructions 32 and 33, and which together delimit axial channels 35 for allowing flushing fluid to be transported through the vibration-damping structure 12 when inside the inner surface of the sleeve 12 there is positioned a rod element in form of an impact rod (see FIG. 1).

Besides functioning as a vibration and noise damping structure, the elongated sleeve 12 according to this embodiment also functions as a support sleeve or a guide tube for the inside rod. This results in that a reconstruction of the drill string component 2 in FIG. 1 has been possible to the extent that it has been possible to omit a central rod guiding portion previously being positioned centrally of the pipe-shaped element 3 in respect of the device according to this aspect of the invention.

Thereby the pipe-shaped element 3 can be manufactured essentially simpler and more economic in that, with reference to FIG. 4, the pipe-shaped element 3 can be produced by welding of an intermediate, long pipe portion 3 at its ends over weld joints 37 and 38 to the first and second joining portions 4 and 7, respectively.

In a device according to the background art it would otherwise have been necessary to arrange a central rod guiding portion to be welded centrally on the pipe portion 36, which would bring about further working operations and more costly construction.

The invention can be modified within the scope of the following claims. The vibration-damping structure can thus be constructed otherwise and as an example be produced from a sound/vibration-damping material which is adhesively applied in a layer on at least a part of the inside of the pipe-shaped element.

One way of achieving this is to use a viscoelastic material i.e. an amorphous material where the viscoelasticity is a result of a diffusion of atoms or molecules inside the material. Alternatively by using materials with amorphous components, the materials in other respects being crystalline. Examples of amorphous materials are coal, rubber, lacquer (acrylic based, polyurethane based, etc.) plastic, (acrylic plastic, PVC, polystyrene etc,) metal alloys (copper-manganese-aluminium alloys) for example incrumate) etc.) or the like. As examples of partly amorphous materials can be mentioned polyamide and polyethylene.

A further example on how to achieve vibration-damping is to use a metal matrix containing a harder material in the form of rods. Thereby the hard material will vibrate against the matrix material and transform vibrations into heat. The soft matrix material can be for example iron, nickel or copper or other soft materials and the hard material can be of diamond, nanocarbon tubes, cubic boron nitride, ceramics or like materials.

When it comes to damping in general, energy shall be emitted through losses in the material and/or to another material having higher material damping, through friction between materials or by applying a material with high damping between two materials.

In some damping materials, for example with viscoelastic properties, the material can be mounted with protection on one side of one or between two more rigid materials in order to manage stress from air flows etc. One example of this is fibre reinforced plastic mixed with viscoelastic layers on steel, which can function in such a way that an inner tube of carbon fibres, glass fibres, Kevlar, metal or the like is arranged in connection with a steel cover over a vibration-damping structure. Composite materials often provide good resistance against wear and degradation.

Figure 5:
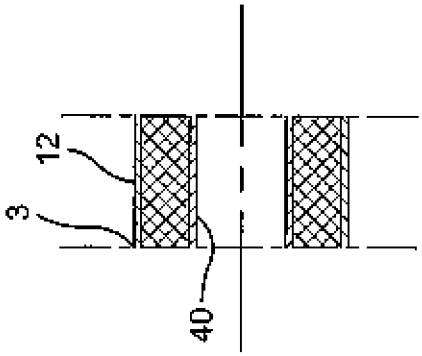
FIG. 5 shows a part of a further alternative drill string component according to the invention.

FIG. 5 illustrates diagrammatically a section of a drill string component with a pipe-shaped element 3 for transfer of rotational movements to a (not shown) drill bit. A vibration-damping structure 12, being comprised of a material chosen from the above groups, lies against the inside of the pipe-shaped element 3. Further, a protective layer 40 according to the above is brought onto the inside of the vibration-damping material in order to reinforce its resistibility against wear etc. according to the above.

With reference again to FIGS. 3 and 4, suitably the vibration-damping structure is in the form of an assembled sleeve being comprised of an extruded or string-moulded long plastic guide, for example of HD polyethylene. It is not excluded that the sleeve is comprised of only one element or that more than two parts are separated by axially and/or radially extending partitions.

The noise damping effect of this aspect of the invention results in that vibrations in the pipe-shaped elements are transferred to the plastic material in the sleeve, which is dimensioned, such that in use it is pressed against the inside of the pipe-shaped element, and are damped out there because of the lower E-module of the plastic and be transformed into heat, which in turn will be led away with the aid of the flushing fluid flowing through the drill string component. The friction between the pipe-shaped element and a sleeve shaped vibration-damping structure can also contribute to damping.

Through arranging, according to the invention, the vibration-damping structure on a pipe-shaped element, which only transfers rotational movements, and wherein impact movements to the drill bit is obtained through other measures, it is further achieved that the arrangement only has to be adapted to such conditions that prevail in respect of the elements that are not subjected to impact action.

It is not excluded that a vibration-damping structure according to the invention can be applied to drill string components of previously known kind, viz. that are provided with a conventional central guide according to the above, whereby in that case a vibration damping structure is suitably inserted at either side of said central guide.

The inner diameter of the vibration-damping structure in the shape of a sleeve in FIGS. 3 and 4 is suitably adapted such that it will only come into contact with the impact rod momentarily and not as an example through the length extension of the plastic at increased temperatures. This is because of the possibility of avoiding negative effects to the operation of the device. When it comes to length dimensions of the vibration-damping structure, it can be made such that essentially the entire accessible space, as seen axially, is filled or only part or plural separate parts thereof are provided with vibration-damping structure.

Mounting of the vibration-damping structure according to FIGS. 3 and 4 is made by inserting the sleeve parts before welding together through friction welding of the pipe-shaped element. A proper distance is allowed hereby from the portions to be welded by moving the structure from the weld area before starting the welding operation. Through this aspect of the invention, straighter pipes can be obtained in that longer steel pipes can be used and two central friction welds be eliminated. Further, straighter pipes results in less thread wear and simplified manufacture with increased capacity and reduced machine costs. Straighter pipes also results in straighter impacts against the drill bit, which results in reduced bending wave vibrations and reduced noise generation.

As an alternative to the arrangement in FIG. 1, in a modified embodiment, a vibration-damping structure/a damping layer on the pipe-shaped elements can be combined with a thin damping layer on the rod elements.

It is not excluded that vibration-damping structures according to the invention can have different sections as circular, rounded, polygonal etc. and have different properties and dimensions along different parts of their lengths.

Figure 6:
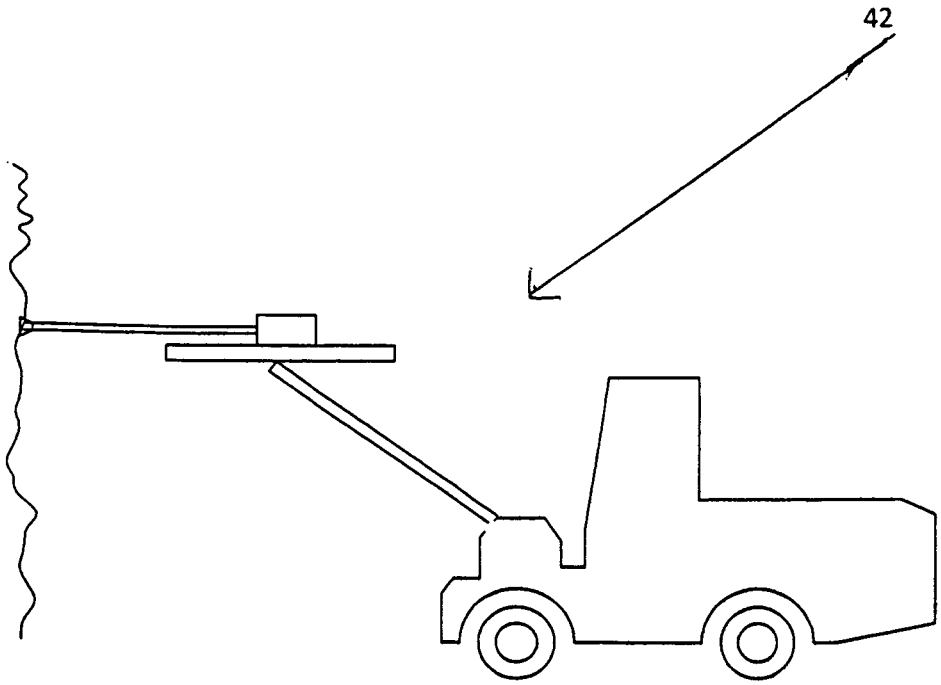
FIG. 6 illustrates a rock drill rig in accordance with the present invention.

FIG. 6 schematically illustrates a rock drill rig designated by reference numeral 42.

All embodiments and varieties of vibration-damping structures described herein can be applied in top hammer drilling as well as down-the-hole drilling.

The invention claimed is:

1. Drill string component for positioning between a top hammer drill rig and a drill bit for percussive drilling and including a pipe-shaped element which transfers rotational movements from the drill rig to the drill bit, and which is arranged to enclose at least one rod element of a drill string extending along a longitudinal axis for transferring impact pulses from a percussion drilling machine belonging to the top hammer drill rig to the drill bit, wherein the pipe-shaped element is arranged concentrically surrounding said at least one rod element, and wherein a vibration-damping structure is arranged adjoining to and rotatable with at least a part of an inside of the pipe-shaped element in a space formed inwardly of said inside for reducing emissions of noise from the drill string component when in operation and being outside a bore hole.

2. Drill string component according to claim 1, wherein the vibration-damping structure is produced from a vibration-damping material which is applied in a layer on at least a part of said inside.

3. Drill string component according to claim 2, wherein said material is any one from the group: 1) viscoelastic materials of a) amorphous materials, b) materials having amorphous components otherwise being crystalline; 2) composite materials with metallic matrix with particles of a material which is harder compared to the matrix material.

4. Drill string component according to claim 3, wherein a side of the vibration-damping structure being faced away from the pipe-shaped element is provided with a reinforcing wear-resistant layer.

5. Drill string component according to claim 2, wherein a side of the vibration-damping structure being faced away from the pipe-shaped element is provided with a reinforcing wear-resistant layer.

6. Drill string component according to claim 1, wherein the vibration-damping structure is formed as an elongated sleeve, which is inserted into said space and which adjoins against at least a part of said inside.

7. Drill string component according to claim 6, wherein the elongated sleeve has at least one axially extending through channel for allowing flow of fluid between the drill rig and the drill bit.

8. Drill string component according to claim 7, wherein the elongated sleeve has an outer shell and inner shell together forming an outer and an inner tube-shaped construction, wherein axially extending distance strips in the form of distance holders are arranged there between.

9. Drill string component according to claim 6, wherein the elongated sleeve has an outer shell and inner shell together forming an outer and an inner tube-shaped construction, wherein axially extending distance strips in the form of distance holders are arranged therebetween.

10. Drill string component according to claim 6 wherein the pipe-shaped element includes a pipe portion with unchanged section along its length which is welded together with two joining portions at its ends.

11. Rock drilling equipment including a rock drill rig and at least one drill string component according to claim 1.

12. Drill string component of a drill string for a percussive down-the-hole drilling machine for positioning between a drill rig and the down-the-hole drilling machine, wherein the drill string component Includes a pipe-shaped element which transfers rotational movements from the drill rig to the down-the-hole drilling machine, whereas impact pulses to a drill bit belonging to the down-the-hole drilling machine are transferred through the down-the-hole drilling machine, wherein a vibration-damping structure is arranged adjoining to and rotatable with at least a part of an inside of the pipe-shaped element in a space formed inwardly of said inside for reducing emissions of noise from the drill string component when in operation and being outside a bore hole, wherein the vibration-damping structure is formed as an elongated sleeve, which is inserted into said space and which adjoins against at least a part of said inside, and wherein the elongated sleeve has an outer shell and inner shell together forming an outer and an inner tube-shaped construction, and axially and radially extending distance strips in the form of distance holders arranged therebetween.

13. Drill string component according to claim 12, wherein the vibration-damping structure is produced from a vibration-damping material which is applied in a layer on at least a part of said inside.

14. Drill string component according to claim 13, wherein said material is any one from the group: 1) viscoelastic materials of a) amorphous materials, b) materials having amorphous components otherwise being crystalline; 2) composite materials with metallic matrix with particles of a material which is harder compared to the matrix material.

15. Drill string component according to claim 13, wherein a side of the vibration-damping structure being faced from the pipe-shaped element is provided with a reinforcing wear-resistant layer.

16. Drill string component according to claim 12, wherein the elongated sleeve has at least one axially extending through channel for allowing flow of fluid between the drill rig and the drill bit.

17. Drill string component according to claim 12, wherein the pipe-shaped element includes a pipe portion with unchanged section along its length which is welded together with two joining portions at its ends.

18. Rock drilling equipment including a rock drill rig and at least one drill string component according to claim 12.

* * * * *